US006809719B2

(12) United States Patent
Wu et al.

(10) Patent No.: US 6,809,719 B2
(45) Date of Patent: Oct. 26, 2004

(54) SIMULTANEOUS SCAN LINE DRIVING METHOD FOR A TFT LCD DISPLAY

(75) Inventors: Cheng-I Wu, Chia-I (TW); Chin-Lung Ting, Taipei (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 133 days.

(21) Appl. No.: 10/063,877

(22) Filed: May 21, 2002

(65) Prior Publication Data

US 2003/0218586 A1 Nov. 27, 2003

(51) Int. Cl.[7] ..... G09G 3/36

(52) U.S. Cl. ..... 345/103; 345/100; 345/98; 345/87

(58) Field of Search ..... 345/87, 90–93, 345/94, 95, 98–100, 103, 88, 204, 205, 208, 210

(56) References Cited

U.S. PATENT DOCUMENTS 4,842,371 A * 6/1989 Yasuda et al. ..... 345/96
6,081,250 A * 6/2000 Shimada et al. ..... 345/94
6,380,919 B1 * 4/2002 Koyama et al. ..... 345/92
6,545,655 B1 * 4/2003 Fujikawa ..... 345/87
6,583,777 B2 * 6/2003 Hebiguchi et al. ..... 345/92
6,630,921 B2 * 10/2003 Janssen et al. ..... 345/100
2001/0052888 A1 * 12/2001 Hebiguchi ..... 345/87
2002/0140691 A1 * 10/2002 Sato et al. ..... 345/212
2002/0180670 A1 * 12/2002 Kim ..... 345/76

* cited by examiner

*Primary Examiner*—Bipin Shalwala
*Assistant Examiner*—Ricardo Osorio
(74) *Attorney, Agent, or Firm*—Winston Hsu

(57) ABSTRACT

A thin film transistor liquid crystal display (TFT LCD) has row pairs of pixels. Each row pair of pixels includes first row pixels arrayed in a first row, and second row pixels arrayed in a second row, together forming columns of pixels. First and second data drivers are provided for each column of pixels. Scan line drivers are provided for each row pair of pixels so that every pixel in a row pair of pixels is connected to the same scan line driver. Every first row pixel in a column of pixels is connected to the same first data driver, and every second row pixel in a column of pixels is connected to the same second data driver.

2 Claims, 7 Drawing Sheets

SIMULTANEOUS SCAN LINE DRIVING METHOD FOR A TFT LCD DISPLAY

BACKGROUND OF INVENTION

1. Field of the Invention

The present invention relates to a scan line driving method for a thin film transistor liquid crystal display (TFT LCD). More particularly, the present invention discloses a method that enables the simultaneous driving of two scan lines in a TFT LCD.

2. Description of the Prior Art

Thin film transistor liquid crystal displays (TFT LCD) are thin, flat panel display devices that can be found in a plethora of electronic goods, ranging from notebook computers and digital cameras, to flight avionics and medical diagnostic tools. TFT LCDs offer crisp, high-resolution images, and have the primary advantage of offering relatively low power-consumption rates while still maintaining good color contrast and screen refresh rates.

Please refer to FIG. 1. FIG. 1 is a simple block diagram of a TFT LCD 10. The TFT LCD 10 is composed of a plurality of pixels 12 that are regularly arrayed in a rectangular manner, forming rows 10R and columns 10C of pixels 12. A particular pixel 12 consequently has a location within the TFT LCD 10 that may be referenced in a Cartesian manner by the row 10R and column 10C in which that particular pixel 12 is located.

Please refer to FIG. 2 with reference to FIG. 1. FIG. 2 is an equivalent circuit diagram 20 for the TFT LCD 10. Each pixel 12 has a circuit equivalent of a driving transistor (TFT) 24 and two capacitors 22*a* and 22*b*, which are electrically connected between the driving transistor 24 and a common electrode 26. The common electrodes 26 may be thought of as a sort of ground, common to all of the pixels 12. Capacitor 22*a* is a circuit equivalent of the TFT array substrate that is used to form the pixels 12. Generally speaking, the capacitor 22*a* is insufficiently large to maintain a driving voltage of the pixel 12 for a suitable length of time. Hence, capacitor 22*b* is provided so that the liquid crystal in the pixel 12 is able to retain the charge associated with a first driving signal until a second driving signal is received. Each driving transistor 24 is further connected to a scan line 28R and to a data line 28C. Each row 10R has a respective scan line 28R, and each column 10C has a respective data line 28C. All driving transistors 24 in the same row 10R are connected to the same respective scan line 28R. Similarly, all driving transistors 24 in the same column 28C are connected to the same respective data line 28C. As noted above, each pixel 12 has a unique address given in row 10R and column 10C coordinates. To turn on or turn off a pixel 12, an appropriate voltage is placed upon the data line 28C corresponding to the column 10C in which the pixel 12 is located, and a scanning voltage is placed upon the scan line 28R corresponding to the row 10R in which the pixel 12 is located, which activates the driving transistor 24 of the pixel 12 to charge or discharge the capacitors 22*a* and 22*b* according to the voltage placed upon the data line 28C. Changing the voltage across the capacitors 22*a* and 22*b* attenuates the visual characteristics of the pixel 12, and in this manner the entire display 10 may be changed at will on a pixel-by-pixel basis.

Due to leakage currents, the capacitors 22*a* and 22*b* must be regularly refreshed to maintain their appropriate voltages, and hence maintain the display integrity of the TFT LCD 10. Typically, this is performed at something like 60 times per second, and is performed a row 10R at a time. Data line drivers 29C are energized according to the display characteristics of each respective pixel 12 in a selected row 10R to activate the data lines 28C. The scan line 28R for the row 10R is then activated by scan line circuitry 29R, while all other scan lines 28R are kept in an inactive state. An entire row 10R is thus written to at once, and the process is repeated for a succeeding row. Note that it is not possible to simultaneously write to two or more rows 10R at a time, as a single signal data line 28C is used to drive a plurality of column pixels 12. When performing the refreshing process, sufficient time must not only be allowed for the charging/discharging of the capacitors 22*a* and 22*b*, but also for the settling of the data drivers 29C. Rapid activation of scan lines 28R before the data lines 29C have settled can lead to inappropriate values being written into the capacitors 22*a* and 22*b* within a row 10R, leading to image degradation of the TFT LCD 10. Similarly, allowing insufficient time for the charging of the capacitors 22*a*, 22*b* will lead to an inappropriate voltage across the capacitors 22*a*, 22*b*, and thus to image degradation. Consequently, signal timing for the data lines 28C and scan lines 28R is very important.

As resolutions increase (i.e., the number of rows 10R and columns 10C increases), it becomes more and more difficult to refresh the TFT LCD 10, as the same amount of time (i.e., $1/60^{th}$ of a second) must be divided over more and more rows 10R. This leaves less and less time for the settling of the data drivers 29C (which have to drive greater numbers of pixels 12), and for the actual refreshing of the capacitors 22*a*, 22*b*. Several solutions have been proposed that have enabled TFT LCDs to support increasingly higher numbers of pixels, such as U.S. Pat. No. 6,081,250, which is incorporated herein by reference. However, in the proposal of U.S. Pat. No. 6,081,250, the data driving circuit has a special design that is not compatible with conventional data drivers.

SUMMARY OF INVENTION

It is therefore a primary objective of this invention to provide a driving method and associated TFT LCD that enables extended row scanning durations. It is a further objective of this invention to provide simplified scan line circuitry in a TFT LCD.

Briefly summarized, the preferred embodiment of the present invention discloses a driving method and an associated thin film transistor liquid crystal display (TFT LCD). The driving method utilizes a TFT LCD comprising a plurality of pixels arrayed as a plurality of rows and a plurality of columns. For a first pixel located at a first row, first column position ($R_1$, $C_1$), and a second pixel located at a second row, the first column position ($R_2$, $C_1$), the first pixel is addressable by a first scan line corresponding to the first row ($R_1$), and a first data line corresponding to the first column ($C_1$), and the second pixel is addressable by a second scan line corresponding to the second row ($R_2$), and a second data line corresponding to the first column ($C_1$). The method comprises setting the first data line to a first pre-determined voltage corresponding to a desired display state of the first pixel. The second data line is set to a second pre-determined voltage corresponding to a desired display state of the second pixel. Subsequently, the first scan line and the second scan line are simultaneously set to a scan voltage. To effect this, the first scan line and the second scan line share the same scan line driver.

It is an advantage of the present invention that by providing for the simultaneous activation of two scan lines, extended row scan line durations are made possible, while also simplifying the scan line driving circuitry.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
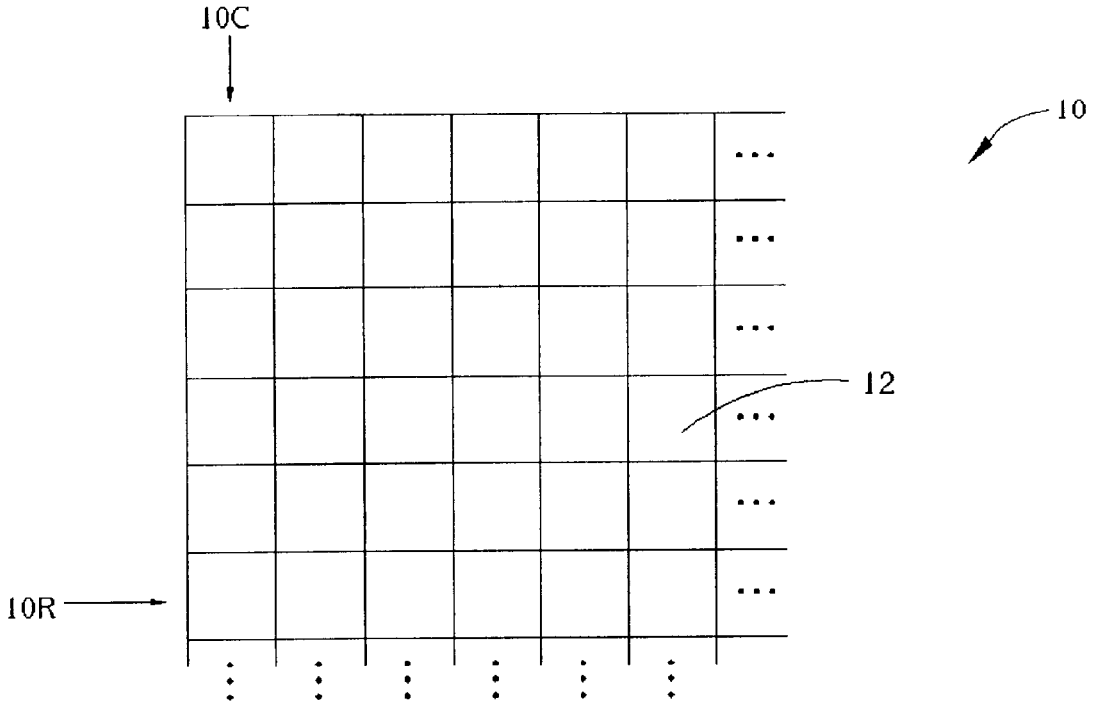
Fig. 1 Prior art
FIG. 1 is a simple block diagram of a prior art thin film transistor liquid crystal display (TFT LCD).
Figure 2:
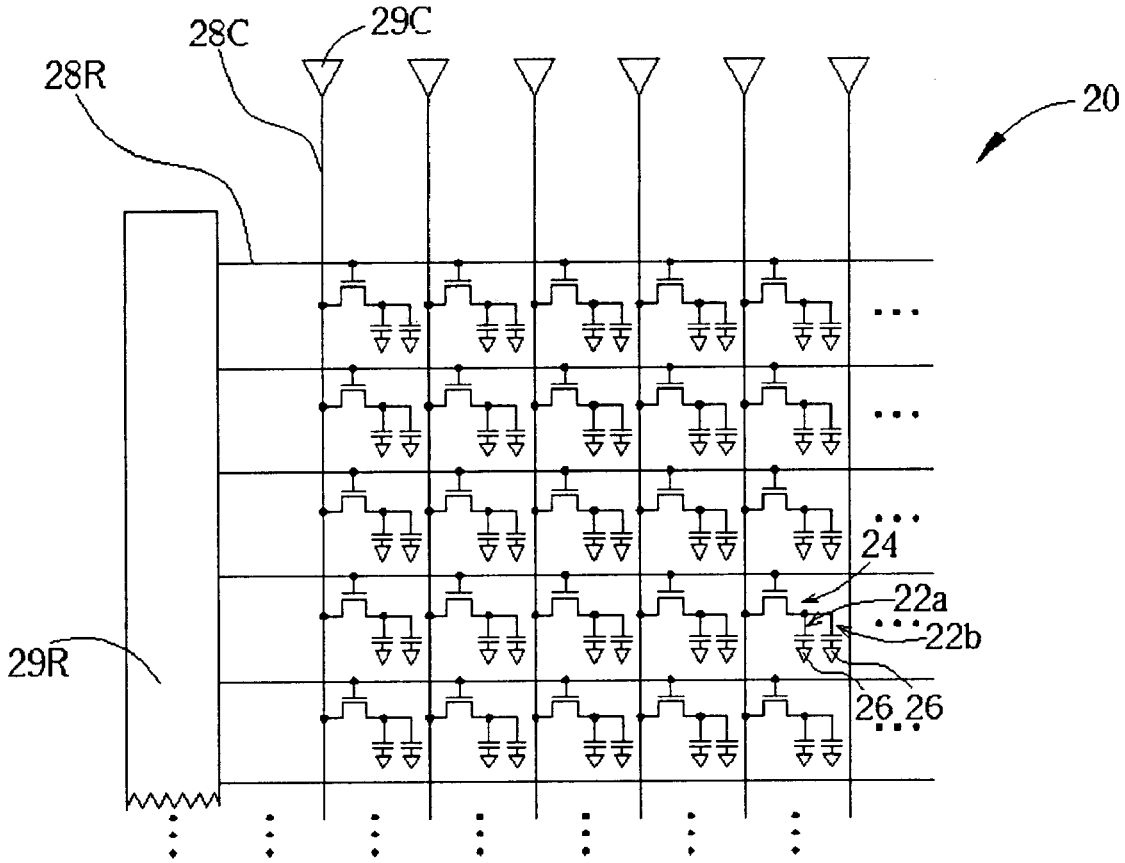
Fig. 2 Prior art
FIG. 2 is an equivalent circuit diagram for the TFT LCD of FIG. 1.
Figure 3:
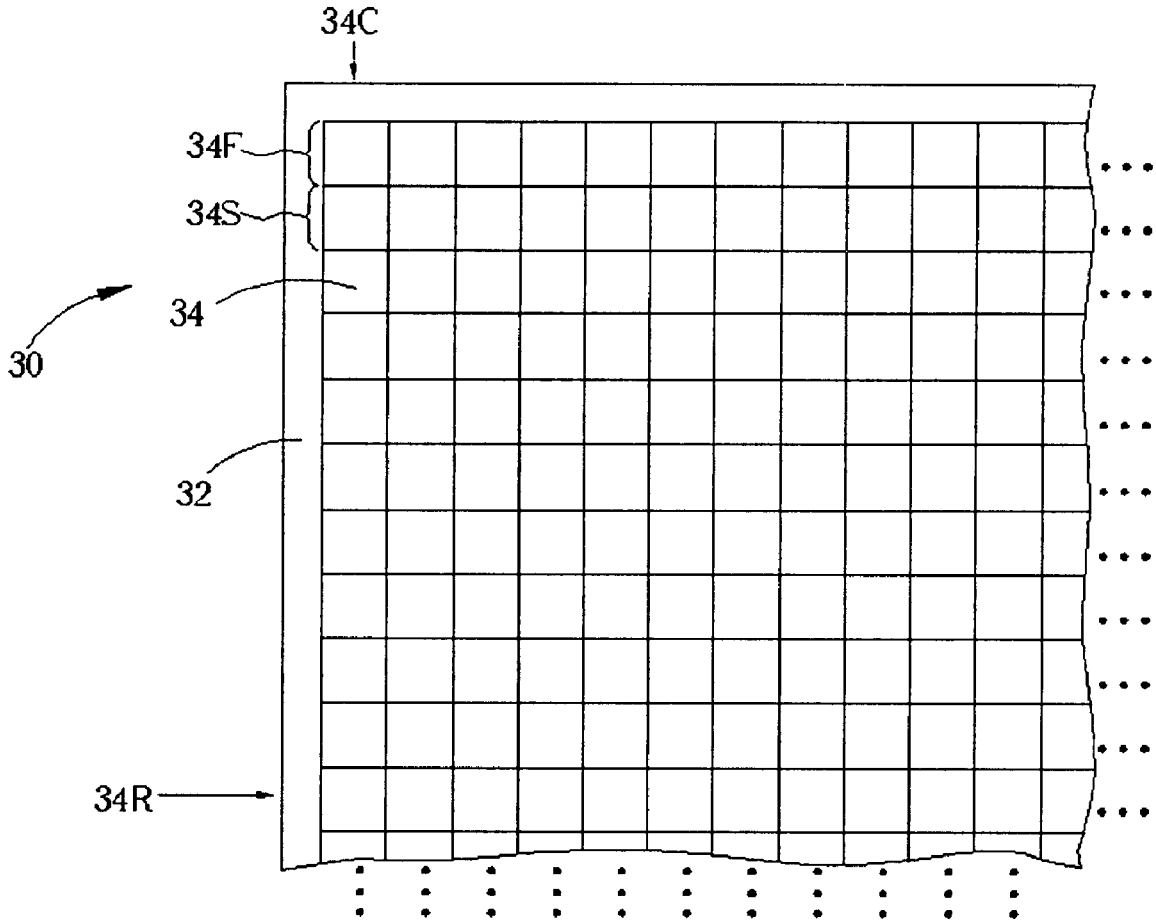
FIG. 3 is a simple block diagram of a TFT LCD according to the present invention.

Please refer to FIG. 3. FIG. 3 is a simple block diagram of a thin film transistor liquid crystal display (TFT LCD) 30 according to the present invention. The TFT LCD 30 comprises a glass substrate 32 upon which a plurality of pixels 34 are disposed. The pixels 34 are arrayed in a rectangular manner, forming columns 34C and rows 34R. The visual characteristics of each pixel 34 are controlled so as to present an image across the TFT LCD 30.

Figure 4:
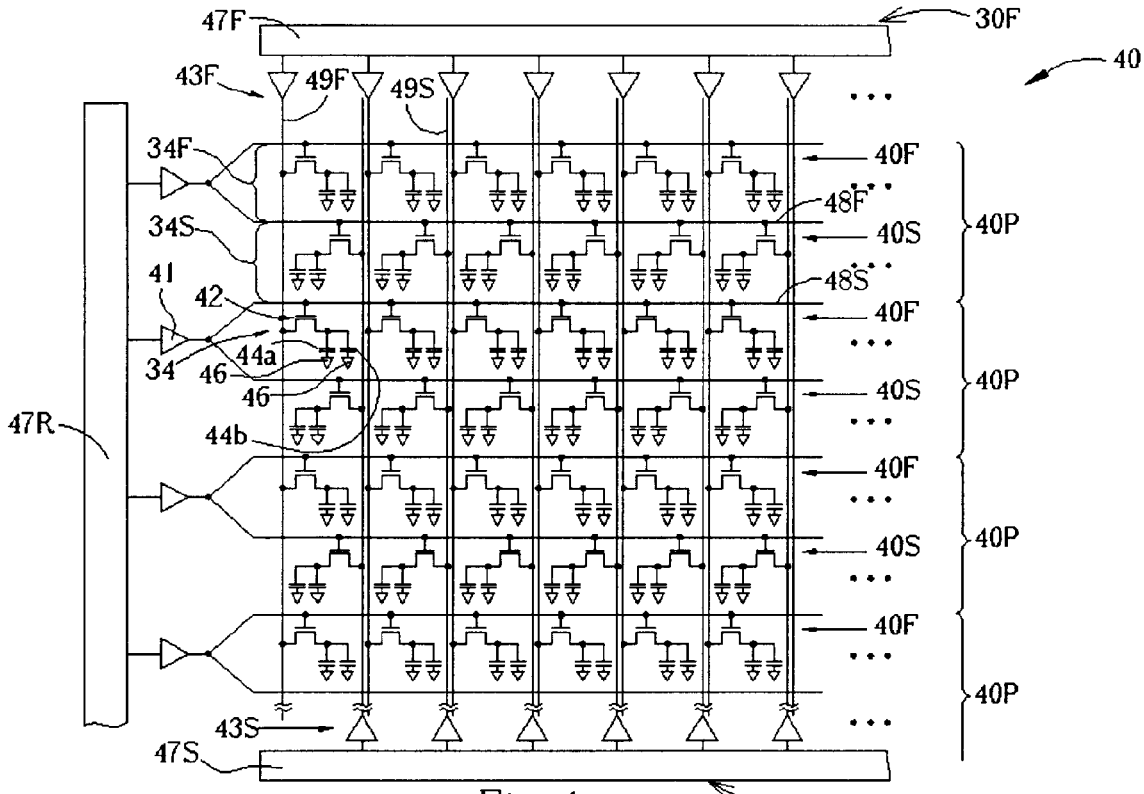
FIG. 4 is an equivalent circuit diagram for the TFT LCD shown in FIG. 3.

Please refer to FIG. 4 with respect to FIG. 3. FIG. 4 is an equivalent circuit diagram 40 for the TFT LCD 30. Within the equivalent circuit diagram 40, each pixel 34 is represented by corresponding capacitors 44*a*, which is formed as a result of the glass substrate 32 upon which the pixel 34 is disposed, in a manner familiar to those in the relevant art. An additional holding capacitor 44*b* is provided to ensure that sufficient charge is available to maintain a display voltage across the pixel 34. Each capacitor 44*a*, 44*b* is controlled by a corresponding driving transistor 42. The driving transistor 42 is used to induce a pre-determined voltage across the capacitors 44*a* and 44*b*, and this voltage controls the display characteristics of the pixel 34. Each of the capacitors 44*a* and 44*b* is further connected to a common electrode 46, which acts as a common reference voltage for all of the pixels 34.

According to the present invention, the rows 34R of pixels 34 are sub-divided into a plurality of row pairs 40P of pixels 34. Each row pair 40P is simply two adjacent rows 34R of pixels 34. Consequently, each row pair 40P comprises a first row 40F of pixels 34, and a second row 40S of pixels 34. Any pixel 34 in a first row 40F may thus be termed a first row pixel 34F. Similarly, any pixel in a second row 40F may be termed a second row pixel 34S. Each first row 40F has a corresponding first scan line 48F, and every driving transistor 42 in a first row 40F is connected to its corresponding first scan line 48F. Similarly, each second row 40S has a corresponding second scan line 48S, to which every driving transistor 42 in the second row 40S is connected. Every row pair 40P has a corresponding common scan line driver 41, and the first scan line 48F and second scan line 48S are connected to their respective common scan line driver 41. That is, for each row pair 40P, the first and second scan lines 48F and 48S within that row pair 40P are both connected to the same common scan line driver 41. The number of common scan line drivers 41 required is thus equal to about half of the number of rows 34R that are present in the TFT LCD 30, which helps to reduce the total amount of circuitry required for the TFT LCD 30.

The TFT LCD 30 also includes a plurality of first data drivers 43F and second data drivers 43S, each driving a corresponding first data line 49F or second data line 49S, respectively. Consequently, every row 34C of pixels 34 has a corresponding first data line 49F and a corresponding second data line 49S. Within a row 34C of pixels 34, every driving transistor 42 for a first row pixel 34F is connected to the same first data line 49F, and hence to the same first data driver 43F. Similarly, within a row 34C of pixels 34, every driving transistor 42 for a second row pixel 34S is connected to the same second data line 49S, and hence to the same second data driver 43S. Every first data driver 43F is located towards a first side 30F of the TFT LCD 30, whereas every second data driver 43S is located towards a second side 30S of the LCD TFT 30. The first and second sides 30F and 30S are preferably opposite sides so that the greater bulk of the width or height of the TFT LCD 30 separates the first data drivers 43F from the second data drivers 43S. This helps to prevent crowding of components on the TFT LCD 30, easing manufacturing and leading to better heat dissipating characteristics of the TFT LCD 30. Note that within a column 34C of a row pair 40P, different data drivers 43F and 43S are used to respectively drive the first row pixel 34F and the second row pixel 34S. It is therefore possible to write to all of the pixels 34 in a row pair 40P at once. The number of refresh steps required to fully refresh the TFT LCD 30 is thus half that required over the prior art, and hence twice as much time for each refresh step is possible. Extended row 34R scanning times are therefore made possible.

Figure 5:
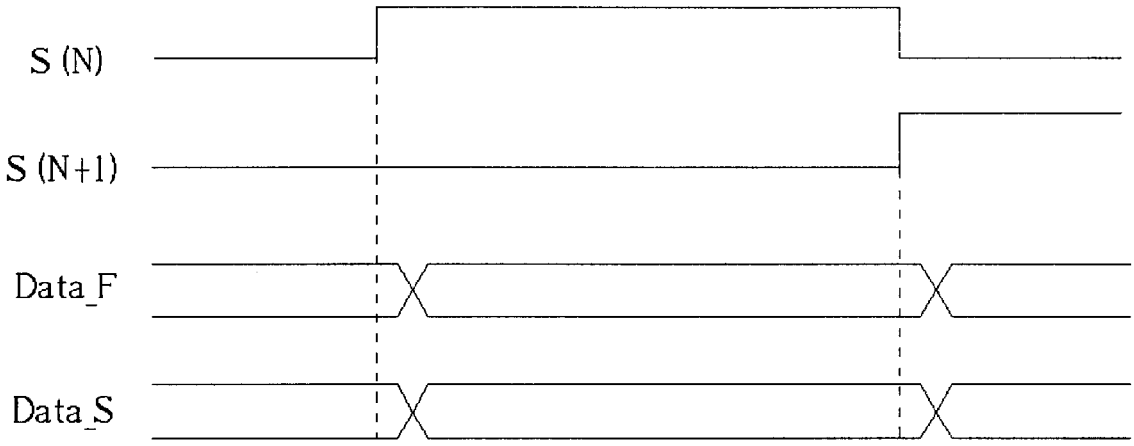
FIG. 5 is a timing diagram for the present invention TFT LCD shown in FIG. 3.

Please refer to FIG. 5 with reference to FIGS. 3 and 4. FIG. 5 is a timing diagram for the present invention TFT LCD 30. Writing to the TFT LCD 30, as in a refresh operation, is performed as follows: 1)Scan line control circuitry 47R selects a target row pair 40P to be written to, which thus has a corresponding target scan line driver 41 that drives the first scan line 48F and the second scan line 48S of the target row pair 40P. The scan line control circuitry 47R causes the target scan line driver 41 to go into an active state to simultaneously place an activating scan line voltage S(N) on both the first scan line 48F and the second scan line 48S of the target row pair 40P.

2)First data line control circuitry 47F causes each of the first data line drivers 43F to assume an output voltage Data_F that corresponds to the desired visual characteristic of its corresponding first row pixel 34F in the target row pair 40P. Similarly, second data line control circuitry 47S causes each of the second data line drivers 43S to assume an output voltage Data_S that corresponds to the desired visual characteristic of its corresponding second row pixel 34F in the target row pair 40P.

3)After a pre-determined amount of time, the duration of which is long enough to ensure that every capacitor 44*a*, 44*b* is sufficiently charged for adequate display quality, the scan line control circuitry 47R causes the target scan line driver 41 to go into the inactive state to stop writing into the target row pair 40P. At the same time, another target row pair is selected and the scan line driver 41 of this other target row pair activated to simultaneously place an activating scan line voltage S(N+1) on both the first scan line 48F and the second scan line 48S of the other target row pair 40P. In this manner, the above process repeats back to step (1).

Figure 6:
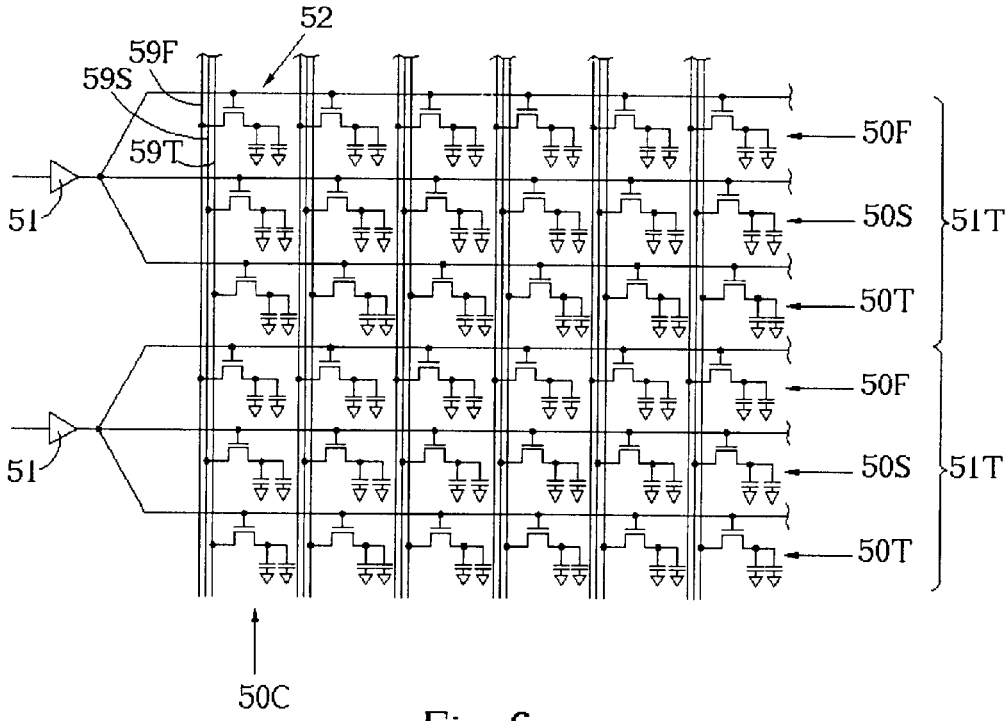
FIG. 6 is another embodiment of a TFT LCD according to the present invention.
Figure 7:
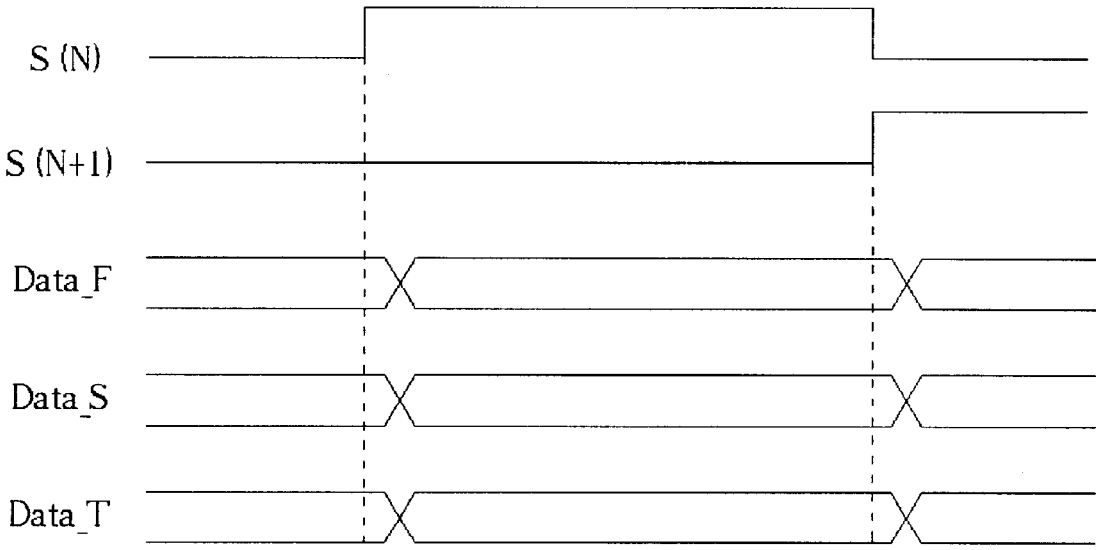
FIG. 7 is a timing diagram for the present invention TFT LCD depicted in FIG. 6.

As another embodiment, it is possible to provide each column of pixels with three data lines, and hence enable the simultaneous driving of three scan lines as a row triplet, rather than two scan lines as a row pair. This embodiment is depicted in FIG. 6. Each row triplet 51T has a first row of pixels 50F, a second row of pixels 50S and a third row of pixels 50T, which are all driven by the same corresponding scan line driver 51. Along a column of pixels 50C, every driving transistor 52 of a first row pixel 50F is connected to the same first data line 59F; every second row pixel 50S is connected to the same second data line 59S, and every third row pixel 50T is connected to the same third data line 59T. Each column 50C has its own set of data lines 59F, 59S and 59T, each of which is connected to a corresponding data line driver. A timing diagram for the embodiment of FIG. 6 is depicted in FIG. 7, in which S (N) represent the output state of an initial scan line driver 51 for an initial row triplet 51T, S(N+1) represents the output state of a subsequent scan line driver 51, Data_F the first data lines 59F, Data_S the second data lines 59S and Data_T the third data lines 59T.

In contrast to the prior art, the present invention provides for a single scan line driver to two or more scan lines of a row group of pixels. Writing is thus performed simultaneously to all of the pixels in a row pair. The present invention can be easily implemented by conventional scan drivers and data drivers. The overall circuit design is therefore simplified. Furthermore, data drivers are disposed over opposite sides of the TFT LCD, providing for a more even circuit distribution, and hence a more even heat distribution, and eases manufacturing concerns.

Those skilled in the art will readily observe that numerous modifications and alterations of the device may be made while retaining the teachings of the invention. For example, it is possible to have three or more rows of pixels share the same common scan line driver, forming a row group. In this case, each column of pixels would have three or more data lines, one for each row in the row group of pixels. Scan line durations in this manner could achieve three or more times the scan line duration over the prior art. Accordingly, the above disclosure should be construed as limited only by the metes and bounds of the appended claims.

What is claimed is:

1. A thin film transistor liquid crystal display (TFT LCD) comprising:

a plurality of row triplets of pixels, each row triplet of pixels comprising a plurality of first row pixels arrayed in a first row, a corresponding plurality of second row pixels arrayed in a second row, and a corresponding plurality of third row pixels arrayed in a third row; wherein the row triplets of pixels form a plurality of columns of pixels;

a plurality of first data drivers correspondingly connected to each first row pixel;

a plurality of second data drivers correspondingly connected to each second row pixel;

a plurality of third data drivers correspondingly connected to each third row pixel;

a plurality of scan line drivers correspondingly connected to the row triplets of pixels; wherein every pixel in a row triplet of pixels is connected to the same scan line driver;

wherein every first row pixel in a column of pixels is connected to the same first data driver, every second row pixel in a column of pixels is connected to the same second data driver, and every third row pixel in a column of pixels is connected to the same third data driver.

2. The TFT LCD of claim 1, wherein each first data driver is located towards a first side of the TFP LCD, and each second data driver located towards an opposite side of the TFT LCD.

* * * * *